United States Patent [19]

Fukui et al.

[11] 4,191,636

[45] Mar. 4, 1980

[54] PROCESS FOR HYDROTREATING HEAVY HYDROCARBON OIL

[75] Inventors: Yoshio Fukui, Fujisawa; Yoshimi Shiroto, Yokohama; Mamoru Ando, Kawasaki; Yasumasa Homma, Yokohama, all of Japan

[73] Assignee: Chiyoda Chemical Engineering & Construction Co., Ltd., Yokohama, Japan

[21] Appl. No.: 913,114

[22] Filed: Jun. 6, 1978

[30] Foreign Application Priority Data

Jun. 7, 1977 [JP] Japan ..... 52-66301

[51] Int. Cl.[2] ..... C10G 13/02; C10G 23/02; B01J 21/14

[52] U.S. Cl. ..... 208/110; 208/96; 208/102; 208/212; 208/251 H; 252/456

[58] Field of Search ..... 208/109, 110, 251 H, 208/253, 212, 86, 102; 252/456

[56] References Cited

U.S. PATENT DOCUMENTS

| | | | |
|---|---|---|---|
| 2,559,285 | 7/1951 | Douce | 208/86 X |
| 3,245,901 | 4/1966 | Beuther et al. | 208/110 |
| 3,258,431 | 6/1966 | Fisher | 208/143 X |
| 3,804,741 | 4/1974 | Robson | 208/110 |
| 3,867,282 | 2/1975 | Fischer et al. | 208/216 |
| 4,062,758 | 12/1977 | Goudriaan et al. | 208/80 |

FOREIGN PATENT DOCUMENTS

| | | | |
|---|---|---|---|
| 52-32003 | 9/1977 | Japan | 208/80 |

*Primary Examiner*—Delbert E. Gantz
*Assistant Examiner*—G. E. Schmitkons
*Attorney, Agent, or Firm*—Armstrong, Nikaido, Marmelstein & Kubovcik

[57] ABSTRACT

This invention relates to a process for continuously converting a heavy oil into an asphaltene-metal-free oil by hydrotreating said heavy oil to crack asphaltenes selectively and remove heavy metals such as vanadium and nickel from said heavy oil simultaneously (hereinafter briefly referred to as "removal of metals"), separating the liquid products into a light fraction of an asphaltene-free and metal-free oil and a heavy fraction of an asphaltene and heavy metal-containing oil (hereinafter referred to as a "heavy fraction"), recovering said light fraction as a product, and recycling said heavy fraction to said hydrotreating step.

11 Claims, 10 Drawing Figures

PROCESS FOR HYDROTREATING HEAVY HYDROCARBON OIL

BACKGROUND OF THE INVENTION

This invention relates to a process for converting a heavy hydrocarbon oil containing asphaltenes and heavy metals in large quantities (hereinafter referred to as a "heavy oil") into a substantially asphaltene-free and heavy metal-free oil (hereinafter referred to as an "asphaltene-metal-free oil").

The heavy oils to be treated according to this invention are petroleum crude oils, residues obtained by distilling crude oil under atmospheric or reduced pressure, crude oils extracted from tar sands or mixtures thereof. These contain large quantities of high molecular weight hydrocarbon compounds having structures consisting of several fragments of condensed aromatics and connecting paraffic chains and/or naphthenic fragments (usually called asphaltenes), heavy metals, sulfur compounds and nitrogen compounds. By the term "asphaltene" as used herein is meant n-heptane insolubles that are determined by the I.P. (Institute Petroleum Great Britain) method.

The heavy oils to be treated according to this invention are those which contain asphaltenes and vanadium in large quantities. Examples of these are: (1) Venezuelan crude oil of 1.004 specific gravity ($D_{15}/4°$ C.) containing as high as 11.8% by weight of asphaltenes, 1240 ppm of vanadium, 5.36% by weight of sulfur, and 5800 ppm of nitrogen; (2) topped crude of Middle-Near East of 0.987 specific gravity ($D_{15}/4°$ C.) containing about 6.5% by weight of asphaltene, 95 ppm of vanadium, 4.45% by weight of sulfur and 3000 ppm of nitrogen; and (3) vacuum residue from the other crude oils of Middle-Near East of 1.038 specific gravity ($D_{15}/4°$ C.) containing about 8.2% by weight of asphaltenes, 270 ppm of vanadium, 3.53% by weight of sulfur and 7300 ppm of nitrogen, and the like.

As described above, these heavy oils contain extremely large quantities of contaminants such as sulfur and nitrogen compounds, and organometallic compounds of vanadium or nickel, etc. These contaminants are concentrated in the fraction of high molecular hydrocarbons like asphaltenes, making the catalytic hydrotreating seriously difficult. At present, therefore, asphaltenes are first separated from the feed oil by a physical process such as a solvent deasphalting process, and the deasphalted oil is hydrotreated, thus avoiding the problems with the contaminants. In removing a large amount of asphaltenes from a heavy oil by a solvent deasphalting process using a low molecular hydrocarbon such as propane, butane, pentane or the like, the asphaltene-containing fraction produced as a byproduct reaches 10–20% by weight and, in some cases, as high as more than 30% by weight, depending upon the quality of extracted oil obtained by deasphalting. Therefore, this process is not a preferred technique for treating a heavy oil containing asphaltenes.

Asphaltene is generally believed to comprise large molecules formed by association of several high molecular compounds comprising condensed aromatic rings. The asphaltene is colloidally dispersed in the oil and usually contains about 4–8% by weight of sulfur and 500–7000 ppm of heavy metals like vanadium.

Heavy oils containing such asphaltenes in a large quantity are abundantly present in nature and are regarded as promising hydrocarbon resources in the future. At present, however, they are utilized merely as an extremely low grade fuel oil or as asphalt for road paving.

With the above described background in mind, extensive investigations have been carried out on techniques for converting a heavy oil containing asphaltenes in large amounts into a valuable asphaltene-heavy metal-free oil.

At present, as an industrial process which can provide said asphaltene-free heavy metal-free oil of superior quality by hydrotreating these heavy oils, there have been proposed the following two processes:

One is a process wherein a heavy oil is subjected to catalytic hydrocracking in the presence of a catalyst having metal compound(s) supported on a carrier, and the other is a process wherein a heavy oil is subjected to catalytic hydrotreating in the presence of a catalyst consisting of non-supported metal compound(s).

In the former process, the reaction system is usually of a fixed bed or an ebullating bed type.

As the process in particular relates to this invention, there are two techniques of treatment that are disclosed in U.S. Pat. No. 2,559,285 and Japanese Open Disclosure of Patent Application No. 32003/1977 (Equivalent to U.S. Pat. No. 4,062,758) in which it has been proposed to recycle a part of the liquid reaction products separated as a heavy fraction. In these processes, however, the presence of asphaltenes and heavy metals in the charge stock would cause many economic disadvantages, which can be fully understood by those skilled in the petroleum refining technology.

That is, the asphaltenes colloidally dispersed in the charge stock consists of huge molecules that can hardly approach the active sites in pores of the catalyst. Therefore, the hydrocracking is seriously inhibited. In addition, the presence of asphaltenes increases the formation of coke and carbonaceous materials, which lead to rapid reduction of catalyst activity.

Another serious problem is the presence of significant amounts of metals in the charge stock. They accumulate on the surface of the catalyst, exert poisoning action on the catalyst and seriously shorten the catalyst life.

As is described above, when a heavy oil is treated according to the conventional catalytic hydrotreating process, the amount of catalyst consumption per unit volume of oil treated becomes exceedingly large. Furthermore, even if the above-described defects were obviated, the conventional catalysts would require severe reaction conditions for the purpose of selective asphaltene-cracking to obtain a light oil, and the reduction of the catalyst activity would be still further accelerated. In addition to the above, there also occurs rapid gas build-up due to the secondary decomposition of the cracked oil; hence, the light oil fraction cannot be obtained in a high yield and the hydrogen consumption increases. Thus, this conventional process has serious drawbacks from the standpoint of economy.

As to the latter process, U.S. Pat. No. 3,723,294 suggests a method for overcoming these difficulties. In this process, a heavy oil is hydrotreated in a slurried state with catalyst to remove metals therefrom. The resulting product is separated into a light oil fraction and a heavy oil fraction slurried with catalyst, which latter fraction is then recycled to the preceding reaction step. This process, however, appears to present serious difficulties due to the use of a slurried colloidal mixture of oil and catalyst. In general, the procedures become seriously complicated as compared with a fixed-bed process or the like. Smooth transportation of the slurry-state reactants and reaction products is difficult under high temperature and pressure. A heat exchanger for heating and cooling the slurry-state reactants and reaction products shows lower heat-exchanging efficiency in comparison with a slurry-free system and is subject to other troubles, like plugging of the flow paths. Gas-liquid separation is very difficult for the slurry-state reaction products. In particular, detection of the slurry-state liquid interface under the existing high temperature and pressure would be technically difficult; apparatus for reducing the pressure of the slurry-state liquid reaction product under high temperature and pressure would suffer extreme corrosion and erosion, and would require special technical considerations from the viewpoint of safety and reliability. Stable operation would be difficult because of the contamination of the slurry in the solvent deasphalting step. In the case where the slurry containing a large quantity of asphaltenic material is discharged from the recycling system, the solid-removing procedure is complicated and, moreover, disposal of the discharged material is a problem. A special pump with special reliability and durability is necessary for recycling transportation and boosted feeding of the slurry-state reactants and reaction products, etc.

As is described above, there are still many problems which must be solved before commercializing the above described process.

An object of the present invention is to provide a process for converting a heavy oil into an asphaltene-free and heavy metal-free oil by effective hydrotreating when said heavy oil contains asphaltenic material in such large amounts that it cannot be processed according to the aforesaid conventional processes.

SUMMARY OF THE INVENTION

The present invention provides an economical process for hydrotreating a heavy oil to produce continuously an asphaltene-free, heavy metal-free oil in high yield with a considerably decreased consumption of hydrogen, as compared with the conventional processes, by carrying out selective cracking of asphaltenes simultaneously with the removal of heavy metals in said heavy oil, employing a catalyst having a carrier containing magnesium silicate as a major component.

DETAILED DESCRIPTION OF THE INVENTION

Figure 1:
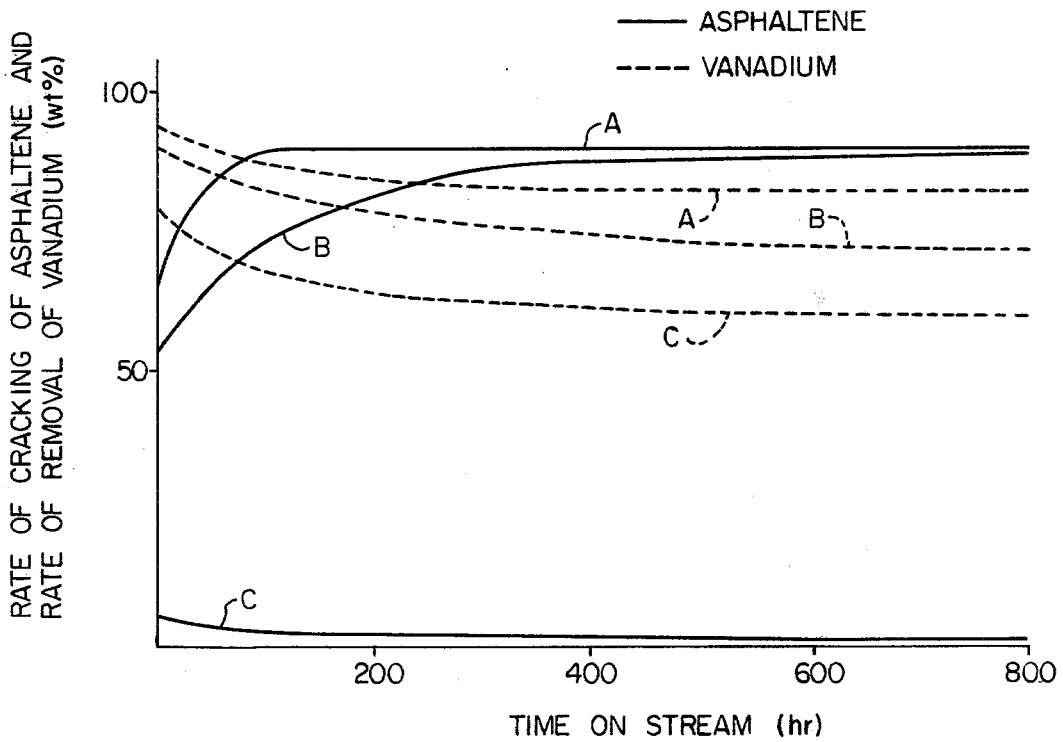
FIG. 1 shows the performance of the catalyst of the present invention for three heavy oils containing different amounts of asphaltene and metal compounds in removing the asphaltene and metals therefrom.

The process of this invention is based on combining a reaction step of hydrotreating a heavy oil which contains charge stock and/or recycled heavy fractions and is referred to as reactor feed oil, and a separation step of the reaction product into a recycling system in which the catalyst having a special function is substantially retained in the reactor.

More specifically, the process of this invention is a process for hydrotreating heavy hydrocarbon oil containing asphaltene and heavy metals to continuously convert it into a substantially asphaltene-free and heavy metal-free oil in a recycling system, which comprises the steps of:

(a) hydrotreating reactor feed oil in the presence of a catalyst comprising a carrier containing magnesium silicate as a major component and having supported thereon one or more catalytic metal components selected from the metals of Groups Va, VIa, and VIII in the Periodic Table under the reaction conditions of: 100–2000 (normal liter/liter) with respect to the hydrogen/oil ratio; 350°–450° C. temperature; 30–250 $kg/cm^2G$ pressure and 0.1–10 $Hr^{-1}$ liquid hourly space velocity, said reactor feed oil being fresh raw heavy hydrocarbon oil and/or oil recycled from the separation step (c) described below of the recycling system, and withdrawing the hydrotreated product without entraining said catalyst therein;

(b) separating said withdrawn hydrotreated product into a hydrogen-rich gas and a liquid product;

(c) separating the liquid product of step (b) as such or a mixture of said liquid product with fresh raw heavy hydrocarbon oil which was fed directly to this step, as the case may be, into a substantially asphaltene-free and heavy metal-free light fraction and an asphaltene-containing and heavy metal-containing heavy fraction; and (d) recycling the heavy fraction of step (c) to step (a) while maintaining the condition that said reactor feed oil to be hydrotreated in step (a) contains at least 5% by weight of asphaltene and 80 ppm or more of vanadium.

The catalyst used in step (a) of the present invention is prepared by distending one or more catalytic metal components selected from the Groups Va, VIa and VIII in the Periodic Table on a carrier containing magnesium silicate as a major component. The identity and the amount of metal of the catalyst are selected depending on the properties of the reactor feed oil or the characteristics of the metals. For example, it is desirable to employ the Group VIII metal in an amount of 1–10% by weight as an oxide, whereas the Group VIa metal is employed in an amount of 4–15% by weight. Preferable metals to be used in the present invention are Co, Mo, W, Ni, and V separately or in combination.

The carrier is a refractory inorganic oxide comprising 30–60% by weight of $SiO_2$, 10–30% by weight of MgO, less than 8% by weight of $Al_2O_3$, less than 25% by weight of $Fe_2O_3$, less than 5% by weight of FeO and less than 3% by weight of CaO, which may be a synthetic material or a natural mineral.

As the carrier, use can be made of any magnesium silicate having neso-structure, ino-structure, or phyllo-structure, but the preferable materials are inosilicates containing hydroxyl radicals and fibrous phyllosilicates. Use can be made of natural products such as anthophyllite, tremolite, actinolite, edenite, riebeckite, chrysotile, sepiolite, attapulgite, etc. and synthetic products closely related thereto in composition and structure.

A particularly effective carrier for the catalyst of the present invention is a natural mineral, sepiolite. This is inexpensively available and its activity can be further enhanced by virtue of its characteristic physical structure.

The inventors have studied using the above-described catalyst for the purpose of developing a process of cracking asphaltenes and converting a heavy oil into a high grade, asphaltene-free, heavy metals-free oil. In particular, the inventors have experimentally examined in detail the interrelation between the asphaltenes contained in the reactor feed oil and the above-described catalyst. As a result, they have discovered a novel fact and have achieved a novel and epochal process for hydrotreating heavy oils based on their discovery.

That is, it has been newly discovered that, when a heavy oil containing asphaltenes and heavy metals in large amounts is hydrotreated in the presence of a catalyst comprising a carrier containing mainly magnesium silicate and supporting the ideitified catalytic metals, there occurs the selective cracking of asphaltenes as well as hydrometallization. In spite of the fact that the metals removed from the reactor feed oil by the hydrometallization overwhelmingly accumulate on the outer surface of the above-described catalyst and the metal layer thus accumulated covers the surface and becomes increasingly thick, the catalyst has been shown to retain enhanced activity in the selective cracking of asphaltenes as well as in the removal of heavy metals.

The reason for this enhanced catalyst activity has not been fully determined, but it is presumed that, in addition to the hydrometallization activity obtained by supporting metals such as Co and Mo on a magnesium silicate carrier, the activity for cracking asphaltenes appears as a result of the interaction between a composition of V-Ni-Co-Mo-S, which contains V, Ni and S removed from the heavy oil and accumulated on the catalyst, along with the Co and Mo as the initial catalytic components and the catalyst carrier.

It is further epochal that the metal compounds which have heretofore been considered poisonous to the catalyst accumulate on the outer surface of the catalyst and yet exert a catalytic action in the practice of the present invention and serve to maintain a stable activity over a long period of time.

In addition, it is worthy of special mention that this unexpected activity of cracking asphaltenes increases as the content of asphaltene and metals, in particular, vanadium, in the reactor feed oil becomes large. Thus, as the reactor feed oil processed according to step (a) of the present invention, preferable are those which contain not less than 5% by weight and preferably not less than 10% by weight, of asphaltenes and not less than 80 ppm, and preferably not less than 150 ppm, of vanadium. With reactor feed oil containing less than 5% by weight of asphaltene and less than 80 ppm of vanadium, the activity of cracking asphaltenes of the catalyst used in this invention cannot be fully exhibited and conversion is reduced.

To illustrate the above described relationship, a specific example is illustrated below. With three charge stocks for the reactor feed oil as shown in Table 1, the rate of conversion of asphaltene and the rate of removal of vanadium versus the time on stream obtained by hydrotreating them using the catalyst of the present invention under the reaction conditions in Table 2 are shown in FIG. 1. The catalyst used was prepared by supporting Co and Mo on a Spanish natural ore, sepiolite, which was taken as carrier and had a chemical composition as shown in Table 3, and then employing extrusion molding. It had the chemical composition and the physical properties as shown in Table 4. The reaction was conducted in a fixed bed isothermal reactor of the gas-liquid, cocurrent, upward flow type.

TABLE 1

| CHARGE STOCK | | | |
|---|---|---|---|
| Charge Stock | A* | B* | C* |
| Specific gravity ($D_{15}/4°$ C.) | 1.004 | 1.025 | 0.948 |
| Asphaltenes (wt %) | 11.8 | 8.7 | 2.5 |
| Sulfur (wt %) | 5.4 | 3.53 | 3.77 |
| Vanadium (ppm) | 1240. | 270. | 50. |
| Nitrogen (ppm) | 5800. | 7000. | 2200. |
| Average molecular weight of asphaltene | 5600 | 3700 | 4150 |

A* Venezuelan crude oil
B* Vacuum residue of Middle Near East crude
C* Atmospheric residue of Middle Near East crude

TABLE 2

| HYDROTREATING CONDITIONS | |
|---|---|
| Reaction temperature (°C.) | 405 |
| Reaction pressure (kg/cm$^2$ G) | 140 |
| LHSV (Hr$^{-1}$) | 0.3 |
| $H_2$/oil ratio (Nl/l) | 1000 |

TABLE 3

| COMPOSITION OF SEPIOLITE | | |
|---|---|---|
| $Al_2O_3$ | (wt %) | 1.3 |
| $SiO_2$ | (wt %) | 56.7 |
| MgO | (wt %) | 23.9 |
| $Fe_2O_3$ | (wt %) | 0.4 |

TABLE 4

| PROPERTIES OF CATALYST (I) | | |
|---|---|---|
| Chemical Composition: | | |
| $Al_2O_3$ | (wt %) | 5.5 |
| $MoO_3$ | (wt %) | 6.9 |
| CoO | (wt %) | 1.9 |
| $SiO_2$ | (wt %) | 48.8 |
| MgO | (wt %) | 18.6 |
| Physical Properties: | | |
| Surface Area (m$^2$/g) | | 171. |
| Pore Volume (cc/g) | | 0.79 |
| Pore Distribution: | | |
| 0–100 Å (cc/g) | | 0.031 |
| 100–200 Å (cc/g) | | 0.094 |
| 200–400 Å (cc/g) | | 0.387 |
| 400–600 Å (cc/g) | | 0.278 |

As is clear from the results shown in FIG. 1, in the case where charge stock A containing asphaltenes and heavy metals in large quantities was hydrotreated, the asphaltene-cracking activity of the catalyst increased after some time from the initiation of the experiment.

The conversion of the asphaltenes reached 90% by weight within a comparatively short time and, thereafter, constant activity was shown for a long period of time. As to the rate of hydrodemetallization, a decrease was first observed but, thereafter, almost simultaneously with the asphaltene-cracking activity becoming constant, it also became constant and remained unchanged over a long period of time.

The results of hydrotreating charge stock B which contained asphaltenes and heavy metals in large amounts, though less than charge stock A, showed the same tendency as charge stock A.

That is, similarly to charge stock A, the conversion of asphaltenes in charge stock B was comparatively high and constant but, as compared with the former, it took a longer time to reach a constant conversion level. Thus, it was found that there is a break-in period before the catalyst exhibits a stable function. As to the removal of vanadium, there were observed the same tendency as in charge stock A though the rate of conversion was slightly lower.

On the other hand, hydrotreating of charge stock C containing less amounts of asphaltenes and heavy metals showed different results as compared with those of charge stocks A and B.

That is, cracking of asphaltenes did not occur even after 800 hours and, as to the removal of vanadium, the activity more or less decreased with oil running time, though comparatively high activity was shown at the start of the experiment.

Additionally, the analysis of asphaltenes in the charge stocks and the product oils shown in FIG. 1 and Table 1 were all conducted based on the standard of Institute Petroleum Great Britain, IP 143/57.

It is also clear from the above results that the difference in the contents of asphaltenes and vanadium in charge stocks exerts unexpected influences on the cracking of asphaltenes and removal of heavy metals. It is further noteworthy that the asphaltene component remaining in the product oil is qualitatively improved. That is, in the above-described experiment, the mean molecular weight of asphaltene in the product oil after 200 hours was greatly reduced from 5600 to 1400 with charge stock A and from 3700 to 1200 with charge stock B, while that of charge stock C changed from 4150 to 4200, thus not being reduced at all.

Therefore, it is seen that the asphaltenic material in the product oil obtained by hydrotreating charge stocks A and B are converted into low molecular asphaltenes which can be easily hydrotreated for hydrodesulfurization or the like.

It can also be understood from the above description that, while the asphaltene contained in the reactor feed oil of low asphaltene content scarcely undergoes catalytic action, the the asphaltene contained in the reactor feed oil of high asphaltene content undergoes catalytic action effectively.

The above described difference in reactivity due to the difference in the oil properties has become clear by analyzing the spent catalyst. Firstly, the vanadium and carbon accumulated on the spent catalyst after hydrotreating charge stocks A and C were analyzed to give the result shown in Table 5, in which the data shows the average values throughout the whole catalyst layers.

TABLE 5

| Charge Stock | A | C |
|---|---|---|
| Vanadium (wt %/fresh catalyst) | 56.0 | 1.5 |

TABLE 5-continued

| Charge Stock | A | C |
|---|---|---|
| Carbon (wt %/fresh catalyst) | 12.8 | 28.4 |

As is shown in Table 5, when charge stock A containing asphaltenes and vanadium in large amounts was hydrotreated, large amounts of heavy metals accumulated on the spent catalyst, whereas carbon deposited in a smaller amount than had been expected. On the other hand, when charge stock C, containing smaller amounts of asphaltenes and vanadium was hydrotreated, carbon deposited reversely in a large amount, while heavy metals accumulated in small amounts on the spent catalyst.

In order to examine in what state said metals and sulfur accumulated on the catalyst, the catalyst used for 800 hours for processing charge stock A under the same conditions was subjected to characteristic X-ray analysis. Results are shown in FIG. 2.

Figure 2:
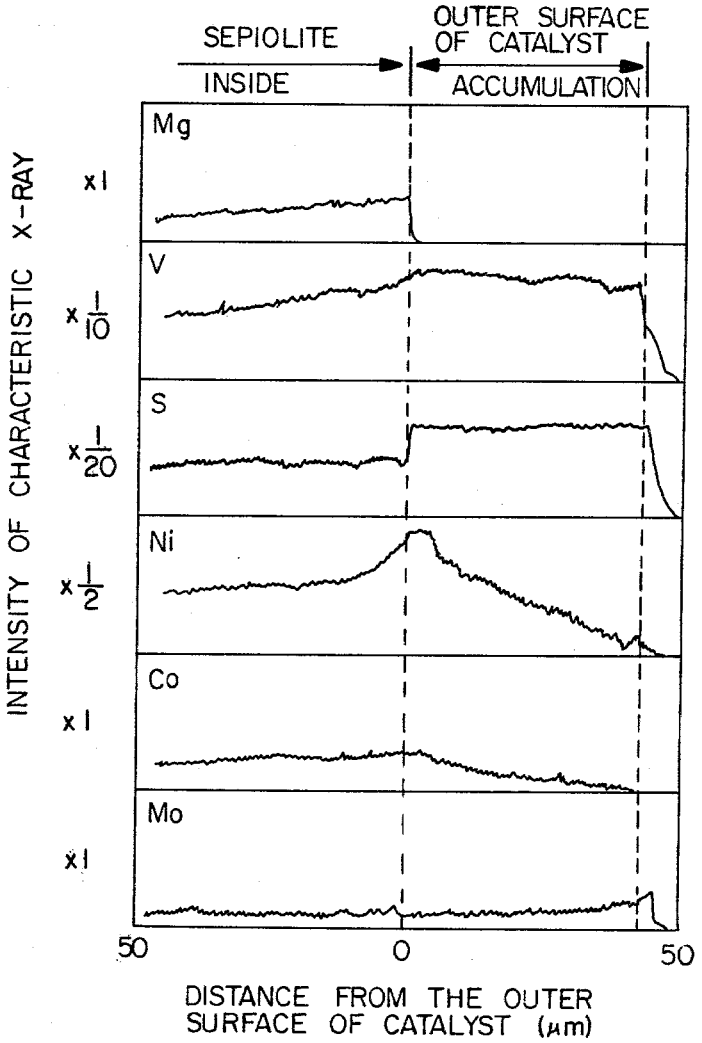
FIG. 2 shows the results of X-ray analyses showing the state of metal accumulation on the catalyst of the present invention after use in hydrotreating.

From FIG. 2, it is found that the heavy metals removed from the heavy oil by this hydrotreating, which have heretofore been believed to accumulate mostly within the catalyst, accumulated overwhelmingly on the outer surface of the catalyst and were fixed there. At the same time, the Co and Mo supported as catalytic metals had migrated from the interior to the outer surface. In the figure, the intensities of Mg, Co and Mo are shown on the same scale, whereas those of V, S and Ni are shown on a scale of 1/10, 1/20 and ½, respectively. Thus, for example, the intensities of Mg and S are shown to be the same in the figure, but the actual intensity of S is 20 times as large as the actual intensity of Mg. The metals on the outer surface of the catalyst form a complicated composition of V-Ni-Co-Mo-S.

The reason why the stable catalytic activity is maintained in spite of the accumulation of heavy metals and sulfur on the outer surface of the catalyst appears to be that the metal compounds heretofore considered as poisons for the catalyst accumulate on the outer surface of the catalyst where they exert a novel catalytic function due to some unknown phenomena.

Further, in view of the fact that these metal compounds mostly accumulate on the outer surface of the catalyst, it is obvious that their recovery from spent catalysts is extremely easy.

On the other hand, with the catalyst used for processing charge stock C containing smaller amounts of asphaltenes and vanadium, it was found that almost all of the heavy metals like vanadium accumulated on the inner surface of the catalyst, but substantially none of them accumulated on the outer surface of the catalyst quite similarly to the catalyst used in the conventional hydrotreating process. From the above described results, it can be easily seen that contents of asphaltenes and heavy metals play an important role in the hydrotreating process.

In addition, when the product oil was filtered to separate it into an oil fraction and a residue and the residue was washed with benzene, there was found only a trace of insoluble matter. This indicates that the product oil contained almost no inorganic compounds and hence, the heavy metals removed from the heavy oil substantially wholly deposited on the catalyst.

The shape of the particles of the catalyst used in the present invention is not particularly limited, but the size is desirably not less than 0.8 mm in a nominal diameter.

Also, the object of the present invention may be realized even when, instead of a catalyst in particulate form, use is made of a catalyst which is prepared by supporting the metal components on a carrier consisting mainly of magnesium silicate supported on another solid material such as for example, the wall of a pipe, etc.

The present invention has also another characteristic in that, since the above described catalyst supported on a solid carrier is used, there can be employed a reaction system wherein the solids such as the catalyst or metal sulfides, which are removed through the reaction, are not entrained in the reaction products from the reaction zone. This is because the above-described catalyst fixes all the metal components removed from the heavy oil as sulfides on the surface to form a composite catalyst as a result of the interaction between them.

Such a catalyst enables the employment of usual reaction systems such as a fixed bed, a moving bed, an ebullating bed and a tubular reactor in the reaction step. This is one of the outstanding characteristic features of the process of the present invention.

Reactants may be fed to the reaction zone either at the upper portion or at the lower portion of the reactor. That is, the gas-liquid flow in the reactor may be either upwardly or downwardly.

In accordance with the present invention, the hydrotreating is carried out in the presence of the above-described catalyst under a temperature of 350°–450° C., preferably 390°–420° C., a pressure of 30–250 kg/cm$^2$G, preferably 80–160 kg/cm$^2$G; and a liquid hourly space velocity (hereinafter referred to as "LHSV") of 0.1–10 Hr$^{-1}$, preferably 0.2–5 Hr$^{-1}$.

If the reaction temperature is lower than 350° C., sufficient catalyst activity cannot be obtained and the conversion of reactants in the hydrotreating step does not reach a practical level. On the other hand, if the reaction temperature is higher than 450° C., undesirable side reactions such as coking, etc., become marked and then cause the deterioration of the product oil, as well as the loss of catalytic activity.

If the reaction pressure becomes less than 30 kg/cm$^2$G, the formation of coke becomes so serious that the normal catalyst activity can hardly be maintained whereas, if it is more than 250 kg/cm$^2$G, the hydrocracking reaction becomes so severe that the hydrogen consumption increases with a decreased yield of the product oil. Hence, a rapid increase in the cost of the reactor, as well as other related apparatus, makes the process entirely impractical from a viewpoint of economy. If the LHSV is less than 0.1 Hr$^{-1}$, the residence time of the feed oil becomes so long that, in particular, the heavier components deteriorate by the action of heat resulting in a degradation of product quality whereas, if more than 10 Hr$^{-1}$, the conversion of reactants per pass becomes too low to be practical.

The hydrogen or the hydrogen-containing gas being supplied to the reaction zone and the reactor feed oil are mixed in a proportion of 100–2000 volumes of hydrogen (0° C., 1 atm) to 1 volume of reactor feed oil (15° C.), i.e., 100–2000 normal liter/liter (hereafter referred to as Nl/l), or preferably 500–1000 volumes to 1 volume (i.e., 500–1000 Nl/l). If the proportion is less than 100 nl/l, hydrogen becomes so deficient in the reaction zone and, at the same time, the transfer of hydrogen into the liquid phase becomes so poor, that coking reactions and the like take place and exert detrimental effects on the catalyst as well as on the properties of the product oil. On the other hand, if it is more than 2000 Nl/l, no additional improvement is seen in the process of the present invention, though no problems are caused with respect to the reaction.

Since the cost of compression required for circulating hydrogen increases with the amount of hydrogen being circulated, 2000 Nl/l is the practical upper limit for circulating hydrogen.

Also, even if hydrogen sulfide is contained in the hydrogen-rich circulating gas to be fed to the reaction zone, it not only has no detrimental effect on the reaction, but also tends to accelerate the reaction when contained in a suitable amount. This is because the catalyst used in the present invention undergoes some interaction with hydrogen sulfide under the above-described reaction conditions and plays some role in maintaining the catalytic activity. Thus, it is within the scope of the present invention that the hydrogen gas to be fed to the reaction zone contains up to 10% of hydrogen sulfide.

The catalyst-free reaction product, after having been processed under the above-described reaction conditions in the hydrotreating step, is transferred to the gas-liquid separation step to separate it into a hydrogen-rich gas and a substantially liquid reaction product.

The gas-liquid separating method and the device therefor may be similar to those which are employed in a desulfurization process, such as a usual fixed bed or an ebullating bed, and are not particularly specified. Since solids such as the catalyst are never contained in the reaction product, the separation and transfer of the liquid products can be performed with ease and, therefore, after the pressure is reduced in a routine manner, the liquid products can be sent to the subsequent separation step.

In the subsequent separation step, the liquid products are further separated into a substantially asphaltene and heavy metal-free light fraction and an asphaltene and heavy metal-containing heavy fraction. Separating means in this separation step is not necessarily special, and the separation can be performed according to commonly utilized methods such as distillation and solvent deasphalting.

In the process system of the present invention, any combination of separation methods can be employed. Since substantially no solids are contained in the liquid products, the separation step can be smoothly operated.

In the case of a solvent deasphalting method being employed in the separation step, use is made of one or more solvents selected from low molecular hydrocarbons such as propane, butane, isobutane, pentane, isopentane, neopentane, hexane, isohexane, etc. These solvents are countercurrently brought into contact with the liquid products.

The solvent deasphalting step is operated under conditions of 10°–250° C., preferably 50°–180° C. temperature, and 3–100 atmospheres, preferably 10–50 atmospheres, pressure.

The solvent-lean heavy fraction obtained from the solvent deasphalting step contains unconverted asphaltenes and heavy metals. This heavy fraction is recycled to the hydrotreating step. However, said heavy fraction does not contain solids such as the catalyst or metal sulfides, so that no special devices and methods are necessary for recycling and transferring it.

By virtue of this recycling of the unconverted asphaltenes in the process of the present invention, the conversion of the asphaltenes per pass need not be extremely high. If the reaction conditions are made severe in order to obtain an extremely high conversion per pass, degradation of the product oil quality due to the occurrence of undesirable side reactions, as well as increases in hydrogen consumption and catalyst consumption, result. Therefore, such adjustment is economically disadvantageous.

The desirable conversion of the asphaltene per pass ranges from 40% to 90%, which may be determined by considering together the properties of the heavy oil, the efficiency in the separation step, and the hydrogen consumption.

The solvent and asphaltene-free and heavy metal-free oil obtained from the solvent deasphalting step are transferred to a solvent recovering section to recover the solvent. Thus, there is obtained an asphaltene-free, hevy metal-free oil. This oil, in most cases, has a molecular weight of no more than 1000. Further, this oil can be hydrodesulfurized quite easily by subjecting it to conventional hydrotreating using a fixed bed, an ebullating bed, etc. to obtain a more valuable hydrocarbon oil. In addition, since the oil obtained by the process of the present invention neither contains heavy metals, e.g., vanadium, no asphaltenes, it is most suitable as a raw oil for fluid catalytic cracking processes or the like to produce high-grade gasoline.

Figure 3:
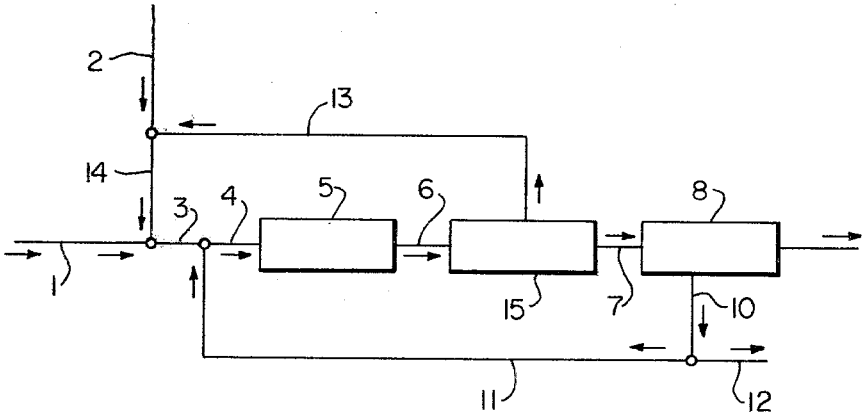
FIG. 3 shows a flow diagram of one embodiment of the process of the present invention.

With reference to the drawings, an embodiment of the present invention will be explained below. In FIG. 3, a charge stock is fed through line 1 and mixed with a hydrogen-rich gas fed through line 14.

The hydrogen-rich gas to be used here is a mixture of recycled gas, separated in gas-liquid separation step 15 after hydrotreated and recycled through line 13, and make-up hydrogen fed through line 2.

The charge stock, mixed with the hydrogen-rich gas is fed through line 3 and further mixed with at least one portion of a heavy fraction containing asphaltenes and heavy metals in large amounts, which was separated in separation step 8. The heavy fraction recycled through lines 10 and 11 is mixed with the charge stock and the hydrogen-rich gas fed through lines 3 and 4 and then led to reaction step 5. The reaction product from the hydrotreating for cracking asphaltenes and removing heavy metals in reaction step 5 is sent to gas-liquid separator 15 through line 6 and separated into a hydrogen-rich gas and liquid reaction products in said gas-liquid separator 15.

The above-described liquid reaction products are then sent through line 7 to separation step 8, and are separated into a substantially asphaltene-free and heavy metal-free light fraction and an asphaltene-containing and heavy metal-containing heavy fraction. The oil produced as a light fraction is withdrawn from the system through line 9.

On the other hand, the above-described heavy fraction is recycled to the reaction step through lines 10 and 11. A portion of the oil being recycled may be withdrawn, if necessary, out of the system through line 12.

Further, the heavy oil as the charge stock is not fed only to the hydrotreating step in admixture with the recycled oil from the beginning, but also may be introduced either into the above-described gas-liquid separator or into a liquid extraction separator step for separating the substantially asphaltene-free and heavy-free light fraction from the heavy fraction, or into the intermediate step therebetween. If the embodiment based on FIG. 3 is designated as [X] and the embodiment in which the charge stock is introduced also into the gas-liquid separator, or the other separator steps as stated above, is designated as [Y], the choice between [X] and [Y] greatly depends upon the properties of the charge stock, especially those of the lighter component thereof, as well as the specified quality of the oil produced. Depending on the differences in the charge stock and the specified quality of the product, choice may be made between [X] in which the whole fraction of the charge stock is introduced into the hydrotreating step and "Y" in which the lighter component of the charge stock is preliminarily separated and recovered as a portion of the product while only the heavier component containing asphaltenes in a large amount is introduced into the hydrotreating step. When considering the hydrotreating step from the aspect of its efficiency, an embodiment [Y] in which the concentrated impurities such as asphaltenes, heavy metals, sulfur and nitrogen are hydrotreated, is preferable from the viewpoint of reaction kinetics. However, in the case where, when the lighter component of the charge stock is separated, most of the above-described impurities largely contaminate the lighter component, or if it is economically disadvantageous to choose the separation conditions so as to reduce the yield of the lighter component for preventing such contamination, the adoption of embodiment [X] is desirable. For example, the relation of the V and Ni contents versus the yield of the lighter fraction obtained by solvent-extracting Venezuela crude oil as shown by A in Table 1 is as follows:

| Yield (% by weight) | 40 | 50 | 60 |
|---|---|---|---|
| V (ppm) | 35 | 60 | 100 |
| Ni (ppm) | 5 | 3 | 11 |

Even when the yield is reduced to a comparatively low level, the metal contents are so high that the light oil thus obtained is entirely unsuitable as such for use as the charge stock for fluid catalytic cracking. In such a case, embodiment [X] is preferable. On the other hand, as an example of the charge stock suitable for the adoption of embodiment [Y], there is a vacuum residue of Middle Near East as shown by B in Table 1. With the lighter component obtained by solvent-extracting the above described vacuum residue, there was obtained the following result:

| Yield (% by weight) | 40 | 50 | 60 |
|---|---|---|---|
| V (ppm) | Trace | 3 | 6 |
| Ni (ppm) | Trace | 1 | 3 |

As is clearly seen from the above result, the amount of the impurities represented by metals is so low in the lighter component that it is economically desirable that the ligher component be preliminarily separated and recovered as product rather than being subjected to hydrotreating together with the heavier component.

It should also be noted that there is another important factor relating to asphaltenes and vanadium contents in the heavy hydrocarbon oils as the charge stock. That is to say, if a charge stock containing asphaltenes and vanadium in comparatively small amounts is treated in [X], the asphaltene and vanadium contents of the charge stock fed to reaction step (a) are less than 5% by weight and 80 ppm, respectively. It was already fully explained above that in such charge stock the catalyst does not exhibit effective activity. Nevertheless, even though in such a case, the object of the present invention cannot be achieved by the treatment in embodiment [X], it can be readily achieved by the treatment in [Y].

For example, if a hydrocarbon oil, such as charge stock C containing less than 5% by weight of asphaltenes and less than 80 ppm of vanadium is pretreated in separation step (c) of [Y], it becomes possible to make the oil fed to reaction step (a) contain at least 5% by weight of asphaltenes and 80 ppm of vanadium that are sufficient for the catalyst to exhibit its effective activity. It should be understood that any processes which utilize embodiments [X] and [Y] as their essential part are within the scope and spirit of the present invention.

Figure 7:
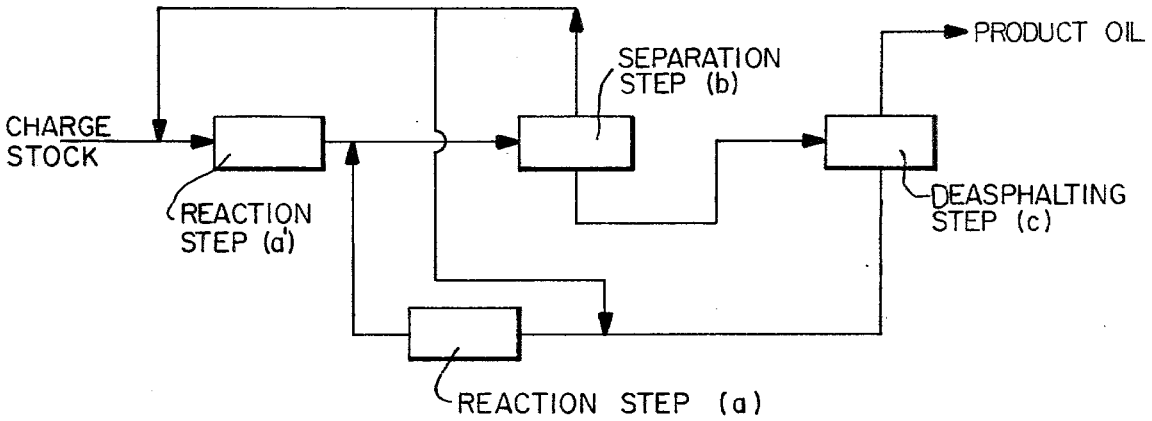
FIG. 7 shows the flow diagram of one embodiment of the present invention.

Referring to FIG. 7, an embodiment is illustrated where a heavy hydrocarbon oil is treated in step (a') which is conducted under the conditions stated below, and the products are introduced to step (b) in the recycling system comprising the steps (a), (b) and (c). In this case, it may be mentioned that step (a') substantially fulfills the function of pretreatment.

Step (a') comprises hydrotreating reactor feed oil in the presence of a catalyst comprising a carrier containing magnesium silicate as a major component and having supported thereon one or more catalytic metal components selected from the metals of Groups Va, VIa and VIII of the Periodic Table under the reaction conditions of a hydrogen/oil ratio of 100–2000 (normal l/l), a temperature of 350°–450° C., a pressure of 30–250 $kg/cm^2G$ and LHSV of 0.1–10 $Hr^{-1}$, and withdrawing the product without entraining said catalyst therein.

The choice of these embodiments may be decided by taking into consideration the properties of the charge stock as well as the properties of the oil aimed at, the conditions of equipment and operation, economy, etc.

The present invention is further illustrated by the following examples and comparative examples. For convenience, the Tables referred to in the examples are set forth following the last recited example.

COMPARATIVE EXAMPLE 1

The following tests were conducted to compare catalyst II, which is a typical catalyst used in the conventional fixed-bed hydrotreating process and has the properties shown in Table 6, with catalyst (I) which is used in the process of this invention and has the properties shown in Table 4.

As a charge stock, a crude oil of Venezuela A containing asphaltenes and vanadium in large quantities was used. The properties of this oil are as shown in Table 1. Catalyst (II) is one of the catalysts used for direct hydrodesulfurization, etc. in hydrotreating which was prepared by supporting Co and Mo on an alumina carrier and extrusion molding.

Figure 4:
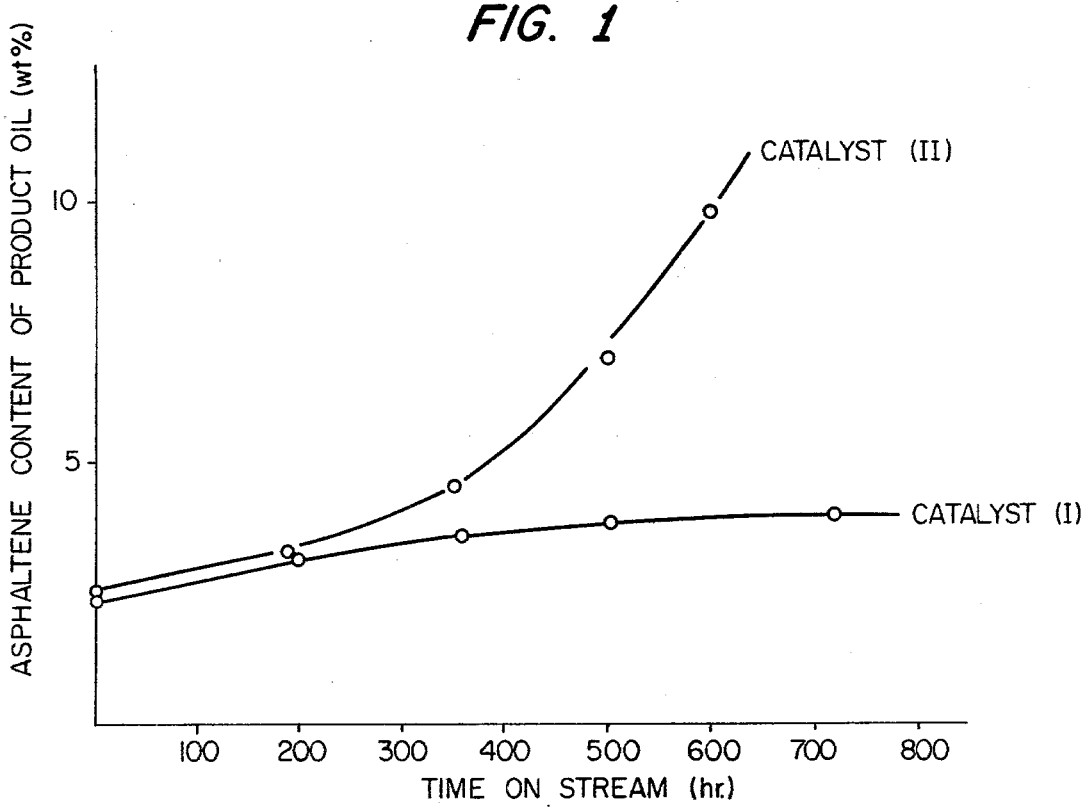
FIG. 4 shows the effect of useage on the present catalyst in comparison with a prior art catalyst in Example 1.

The apparatus used for the experiment was the aforesaid fixed-bed isothermal reactor of gas-liquid cocurrent upward flow type. The reaction conditions were the same as shown in Table 2. The results are shown in FIG. 4. It is clear that the activity of catalyst (II) rapidly declined.

The above results confirm the excellence of catalyst (I) of the present invention. In addition, there is a unique difference between I and II: in the case where the product oils of the same asphaltene content are obtained using catalysts (I) and (II), the former catalyst is markedly superior to the latter with respect to the consumption of hydrogen.

Table 7 shows the result of the comparison of the consumption of chemical hydrogen and the vanadium content in the product oils which had substantially the same asphaltene content, 3.1% by weight. As is apparent from the Table, catalyst (II) consumed about twice as much hydrogen as catalyst (I) did to attain the same asphaltene conversion. Furthermore, the vanadium content in this case was about three times that in the case of catalyst (I), so that the rate of removal of vanadium was very low.

As has been demonstrated by the above comparative example, the process of the present invention is extremely superior as an economically practical process for converting a heavy oil into an asphaltene-free and heavy metal-free oil to the conventional hydrotreating process using a fixed bed or the like.

For further comparison, there were also taken photomicrographs of the spent catalysts which suggested the functional difference between catalysts (I) and (II).

Figure 8:
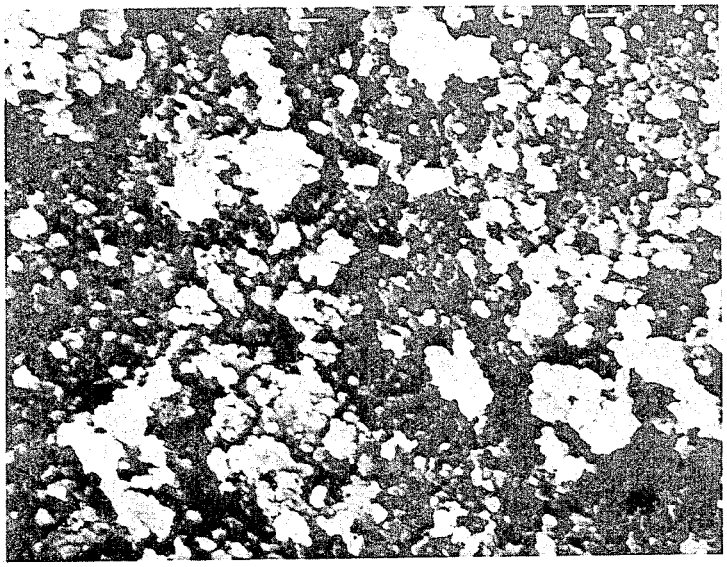
FIG. 8 shows the photograph which indicates the outer surface before use of catalyst (I) of the present invention.
Figure 10:
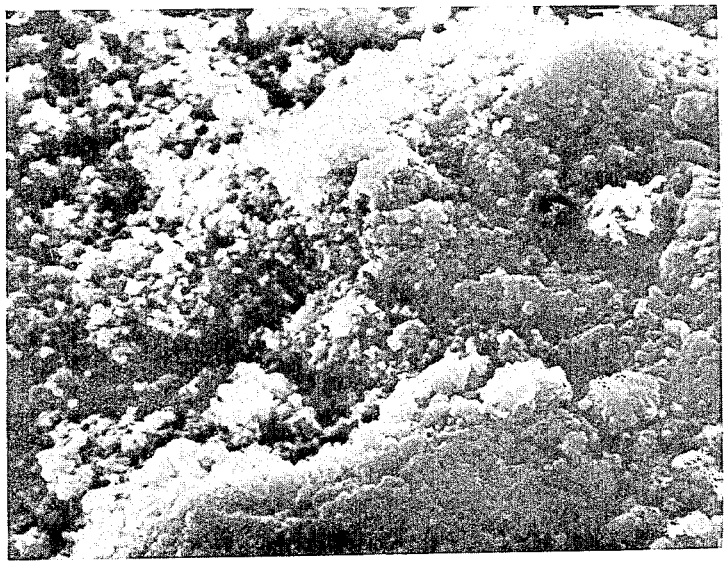
FIG. 10 shows the photograph which indicates the outer surface after use of catalyst (II) of the prior art.
Figure 9:
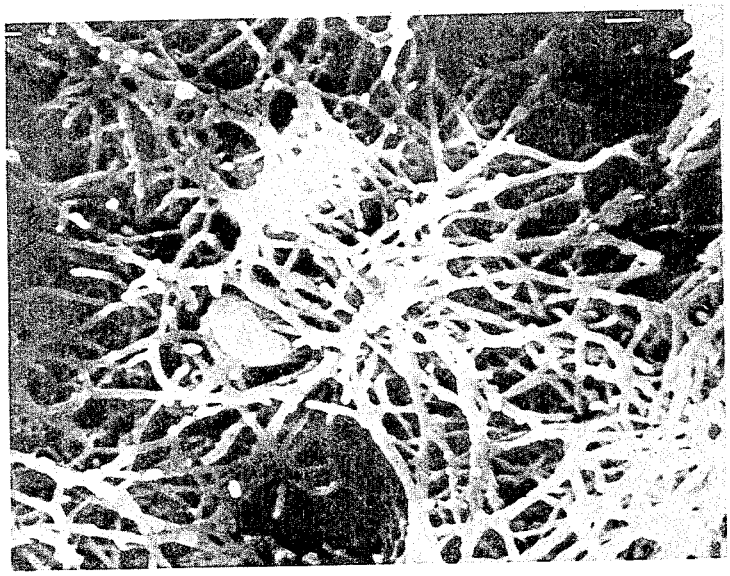
FIG. 9 shows the photograph which indicates the outer surface after use of the above-mentioned catalyst (I)

After a lapse of 800 hours from the initial start-up, both catalysts used in the experiment were withdrawn from the reactor, and the photographs of the outer surfaces of these spent catalysts were taken by means of a scanning electron microscope and shown as FIGS. 8, 9 and 10. FIG. 8 indicates the outer surface before use of catalyst (I) related to the process of the present invention and FIG. 9 indicates the outer surface after use of the same catalyst (I).

There is found a marked difference between these Figures in that one can observe minute fibrous crystals grown on the outer surface of spent catalyst (I). Such a fibrous material is a complicated composition of V-Ni-Co-Mo-S as already stated and, although it is not as yet clearly known what part of this composition contributes to the catalytic activity, it is presumed that these minute fibrous crystals play a certain role in the cracking of asphaltenes.

On the other hand, with regard to catalyst (II), which showed no significant effect upon the cracking reaction of asphaltenes as is seen from FIG. 10, no fibrous crystals are present on the outer surface of the spent catalyst, but instead granular crystals are found on the surface in quite the same way as in the fresh catalyst (I).

COMPARATIVE EXAMPLE 2

This example illustrates that the catalyst related to the present invention greatly contributes to the selective cracking of asphaltene as compared with the conventional catalysts used in the hydrotreating.

The catalysts used were respectively the same as catalyst (I) in Table 4 and catalyst (II) in Table 6, the charge stock fed was also the oil designated by A in Table 1 and, as the experimental apparatus, use was made of the above-described fixed bed isothermal reactor of gas-liquid cocurrent upward flow type. The reaction conditions are shown in Table 8.

In order to clarify the difference in the selectivity, the same operating conditions were employed and the hydrogen consumption per pass was chosen so as to be equal, although in the case of catalyst (II) the decrease in the hydrogen consumption accompanying the decrease in the catalytic activity varied largely depending on the lapse of the reaction time.

Thus, it was after a lapse of about 450 hours that the hydrogen consumption had become equal in both cases.

It is found that, even under the same conditions with the same hydrogen consumption per pass, the cracking of asphaltenes and the removal of vanadium can be achieved more selectively in the treatment of catalyst (I).

Figure 5:
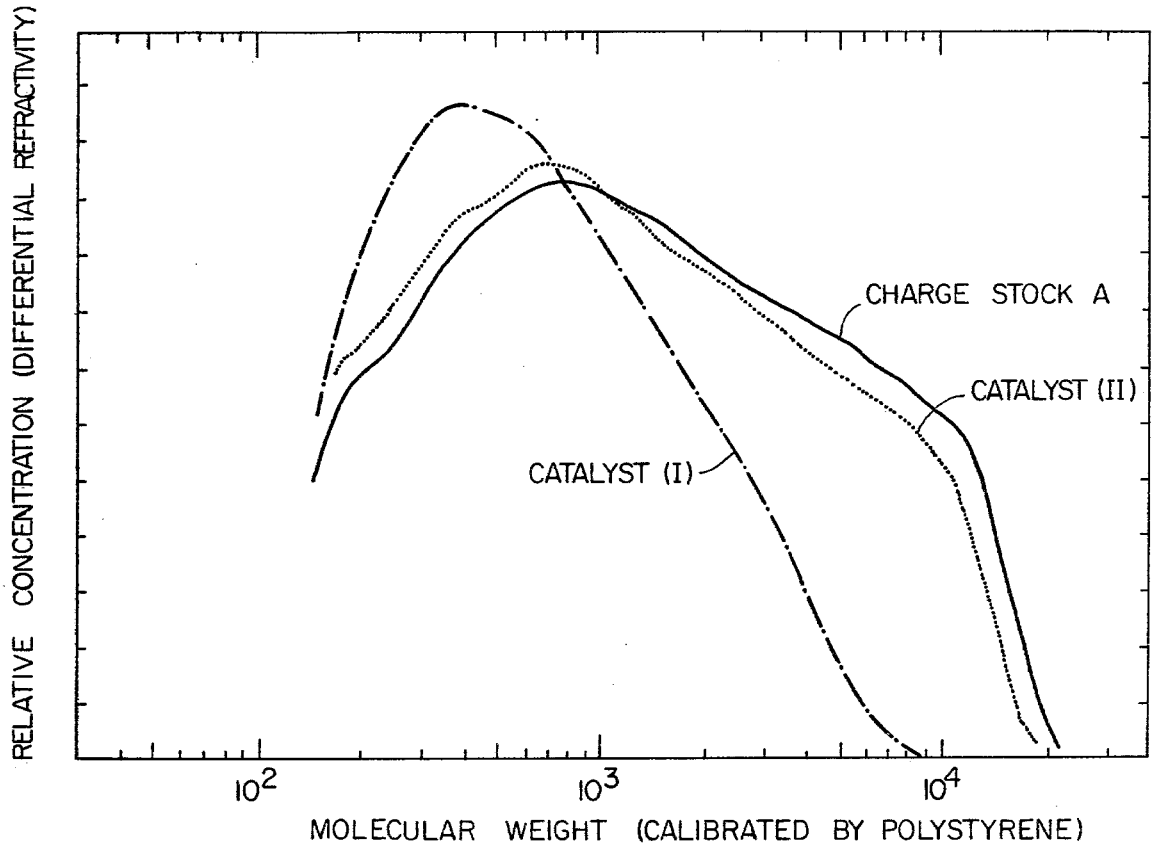
FIG. 5 shows the results of G.P.C. in the Comparative Examples.
Figure 6:
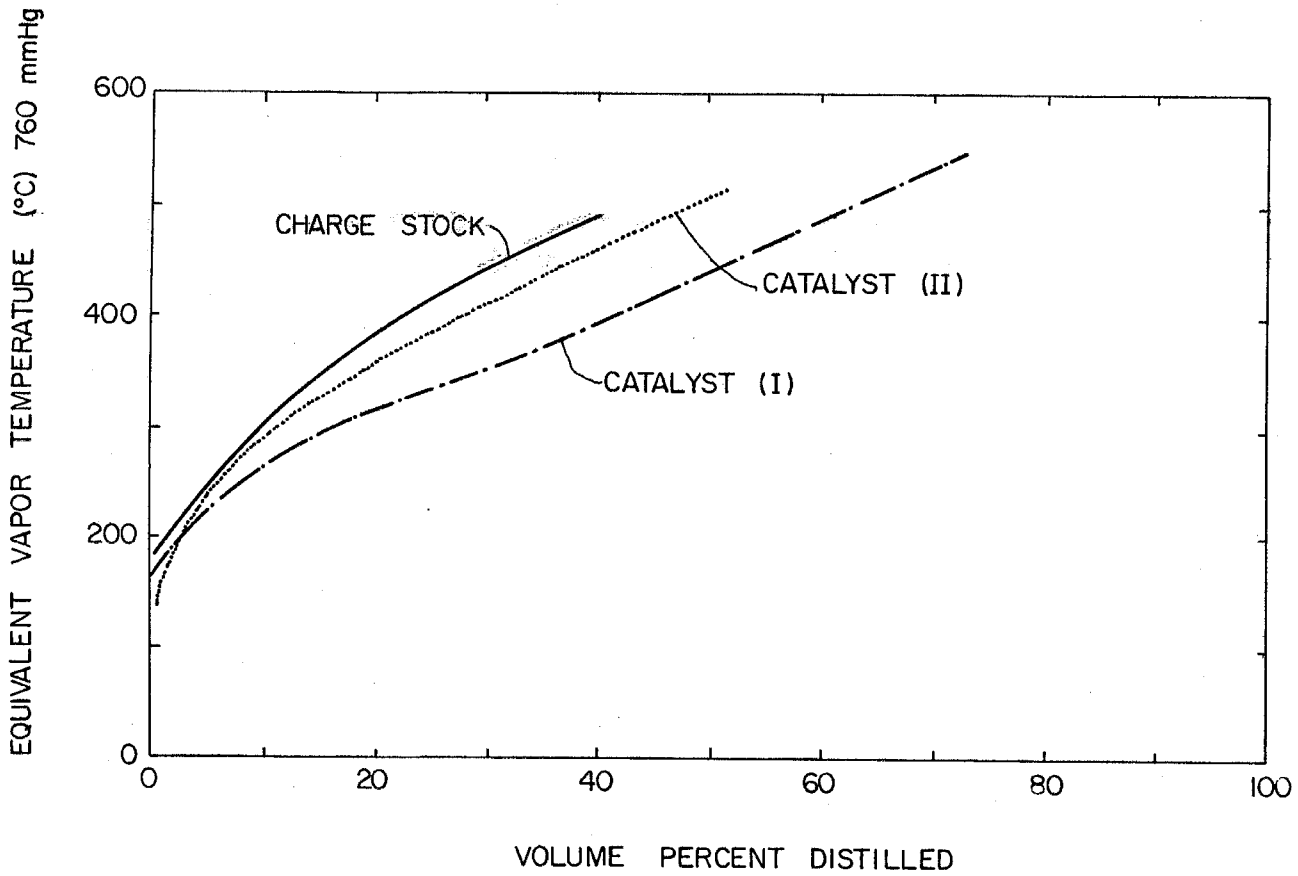
FIG. 6 shows the results of one ASTM distillation in the Comparative Examples.

Further, when viewing the molecular weight distributions (FIG. 5) and the distillation curves (FIG. 6) of the charge stock and of each of the product oils, it is brought to light all the more clearly that catalyst (I) of the present invention is outstanding in that the heavy fraction can effectively be converted into the light fraction irrespective of the same hydrogen consumption.

The molecular distribution was measured according to Gel Permeation Chromatography using polystyrene as packing and chloroform as developer, and the distillation curve was obtained according to ASTM-D1160.

EXAMPLE 1

Charge stock A containing asphaltene in a large quantity was subjected to a series of hydrotreating by the use of catalyst (I) based on the requirements of the present invention to produce an asphaltene-free and heavy metal-free oil. The results are shown below. Charge stock A containing asphaltenes in a large quantity was mixed at a flow rate of 300 cc/hr with a hydrogen-rich gas in a hydrogen/oil ratio of 1000 Nl/l, i.e., at a hydrogen flow rate of 300 Nl/hr, and then preheated in a heater and sent to the reaction step.

The reaction step was carried out in a fixed bed isothermal reactor of gas-liquid cocurrent upward flow type filled with catalyst (I). The reaction conditions are shown in Table 8.

The reaction product obtained from said reaction step was separated into a hydrogen rich gas and a liquid product in a gas-liquid separator. As to the separating conditions in the gas-liquid separator, the pressure was substantially the same as in the reactor and the temperature was 150° C.

Further, the hydrogen-rich gas was scrubbed in an amine scrubber to remove the impurities such as excess hydrogen sulfide and ammonia and, after having been mixed with make-up hydrogen fed to the reaction step, was used for recycling. Also, in order to avoid excessive increase in the light hydrocarbon gas concentration in the recycled gas, one portion, about 10% of the recycling was withdrawn from the system. The above described liquid product was sent to a solvent deasphalting section, where deasphalting was effected using butane at an average tower temperature of about 130° C. under a pressure sufficient to maintain a liquid phase operation (40 kg/cm$^2$G in this example).

In this deasphalting section, about 75% by volume of the above-described liquid product was separated and transferred into the solvent phase, which was then sent to a solvent-recovering unit to recover the solvent.

A heavy undissolved fraction containing a large amount of asphaltenes was recycled at about 200° C. to the reaction step. The amount recycled in this case was 100 cc/hr. The charge point of the recycled oil was located on the charge stock feeding line upstream of the place where the oil was mixed with the hydrogen-rich gas. In this example, continuous operation over a period of 600 hours was attained. The product oil was of excellent quality and extremely low in asphaltenes and heavy metals. The properties of the product asphaltene-free and heavy metal-free oil are shown in Table 9. The yield of the product was not less than 96% by weight, and the chemical hydrogen consumption was 430 SCF/BBL.

In the above-described hydrotreating step, hydrodesulfurization reaction also took place considerably in addition to the asphaltene-cracking reaction and the hydrodemetallization reaction. In this example, the hydrodesulfurization was about 55%. The theoretical hydrogen consumption for this hydrodesulfurization was about 400 SCF/BBL under the assumption that 3 moles of hydrogen per g atom of sulfur is consumed.

EXAMPLE 2

In this example, there are shown the results of a series of hydrotreating experiments using as charge stock a substantially asphaltene-free and heavy metal-free light oil prepared from a vacuum residue of Middle Near East, whose properties are as shown in Table 12, using the above-described catalyst (I) in accordance with the above-described embodiment [Y].

The charge stock is first mixed with the liquid products obtained in the reaction step and then sent to deasphalting section, where deasphalting is effected using butane at an average tower temperature of 125° C. under a pressure of 40 kg/cm$^2$G. In this deasphalting section, about 48% by volume of the above described liquid mixture was separated and transferred into the solvent phase, which was sent to a solvent-recovering unit to recover the solvent. On the other hand, the heavy fraction containing a large amount of asphaltenes which was not dissolved in the solvent was fed at about 200° C. to the reaction step. In the reaction step, the hydrotreating was carried out by the use of the above-described catalyst (I) under the reaction conditions shown in Table 13.

The hydrotreated product is separated into gaseous reaction product and a liquid product in a gas-liquid separator. The separation conditions were such that the pressure was substantially the same as in the reactor and the temperature was about 150° C.

The liquid product was mixed with the charge stock fed to the deasphalting section by recycling to the feeding line of said charge stock as above described. The flow rates of the main stocks in this experiment are as follows:

| | |
|---|---|
| Charge Stock | 476 g/hr |
| Product Oil | 449 g/hr |
| Recycling liquid products | 486 g/hr |

This example recorded successfully a continuous operation over a period of about 1200 hours. The product was an asphaltene-free and heavy metal-free oil of superior quality. The yield of the product oil was 97% by weight on the basis of hydrocarbon, and the chemical hydrogen consumption was 370 SCF/BBL.

EXAMPLE 3

In this example, it is shown that even in the case where the amounts of asphaltenes and vanadium contained in the charge stock are unfavorably small, the object of the present invention can be achieved by the adoption of the embodiment [Y].

As the charge stock, use was made of an atmospheric residue of Near Middle East whose asphaltenes and vanadium contents fell short of 5% by weight and 80 ppm, respectively, having the properties as shown in Table 1.

As described in Example 2, the charge stock was first mixed with the liquid products from the reaction step, and then sent to deasphalting section, where the deasphalting was effected using butane at an average tower temperature of 128° C. under a pressure of 40 kg/cm$^2$G.

In the deasphalting section, about 75 percent by volume of the above-described liquid mixture was separated and transferred into the solvent phase, which was sent to a solvent-recovering unit to recover the solvent.

On the other hand, the heavy fraction containing a large amount of asphaltenes which were not dissolved in the solvent was fed at about 200° C. to the reaction step. In the reaction step, the hydrotreating was carried out by the use of the above-described catalyst (I) under the reaction conditions shown in Table 13 that are the same as those in Example 2.

The hydrotreated products were separated into a gaseous product and liquid product in a gas-liquid separator. The separation conditions were such that the pressure was substantially the same as in the reactor and the temperature was 150° C.

The liquid products were mixed with the charge stock fed to the deasphalting section by recycling to the feeding line of said charge stock as above described. The flow rates of the main stocks in the example are as follows:

| | |
|---|---|
| Charge stock | 410 g/hr |
| Product oil | 390 g/hr |
| Recycling liquid products | 110 g/hr |

This example also recorded successfully a continuous operation over a period of 1000 hours.

The product was an asphaltene and heavy metal-free oil of superior quality containing only minor amounts of asphaltene and vanadium. The yield of the product oil was about 98% by weight on the basis of hydrocarbon, and the hydrogen consumption was 310 SCF/BBL.

The above-described example also clearly shows the advantages to be obtained by practicing the process of the present invention.

The asphaltene-free and heavy metal-free oil to be obtained by the present invention contains substantially no asphaltene and extremely small amounts of heavy metals. Therefore, it is an ideal charge stock for subjecting to the conventional fixed bed hydrosulfurization, hydrocracking, or fluid catalytic cracking, etc.

EXAMPLE 4

In this example, there are shown the results of a series of hydrotreating experiments, which were carried out in accordance with the flow diagram of the process as shown in FIG. 7, i.e., a process which utilizes the already-described step (a') in combination as the step fulfilling the function of pretreatment.

The charge stock used was a vacuum residue of Middle Near East, which is the same as that used in Example 2, having the properties as shown in Table 12 and the catalyst used in the reaction steps (a') and (a) was also the same as the above-described catalyst (I).

The charge stock is mixed with a portion of the hydrogen-rich gas which is recycled from gas-liquid separation step 2 and then sent to reaction step (a'). The operation conditions employed in reaction step (a') are shown in Table 16. The products treated in step (a') are then mixed with the products which are obtained when the heavy fraction containing large amounts of asphaltenes and vanadium, which fraction was separated in deasphalting step (3), is further treated in reaction step (a) and, thereafter, sent to gas-liquid separation step (2).

The separation conditions in step (2) were such that the pressure was substantially the same as in the reactor and the temperature was 150° C.

The hydrogen-rich gas separated in said gas-liquid separation step is recycled to each reaction step after purification.

On the other hand, the liquid products are fed to the above-described deasphalting step (3), in which deasphalting is effected using butane at an average tower temperature of 145° C. under a pressure of 40 kg/cm$^2$G.

In the deasphalting step, about 61% by volume of the above-described liquid mixture was separated and transferred into the solvent phase, which was sent to a solvent recovery unit to recover the solvent as well as the product oil containing substantially no asphaltene and heavy metals.

The fraction containing large amounts of asphaltenes and heavy metals which were not dissolved in the solvent was mixed with the hydrogen-rich gas recycled from gas-liquid separator (2) and then hydrotreated in reaction step (a). The operation conditions in step (a) are shown in Table 17.

The products in step (a) are mixed for recycling with the products in step (a').

The flow rates of the main stocks in this example are as follows:

| | |
|---|---|
| Charge stock fed to step (a') | 475 g/hr |
| Product oil | 452 g/hr |
| Recycling charge stock fed to step (a) | 360 g/hr |

This example also recorded successfully a stable and continuous operation over a period of about 1000 hours.

The products were an oil of superior quality containing only minor amounts of asphaltene and heavy metals as shown in Table 18, which is comparable to that obtained in Example 2 as shown in Table 14.

The yield of the product oil was about 97% by weight on the basis of hydrocarbon, and the hydrogen consumption was 360 SCF/BBL.

Table 6

| Properties of Catalyst (II) | | |
|---|---|---|
| Chemical Composition | | |
| $Al_2O_3$ | (wt %) | 78.4 |
| $MoO_3$ | (wt %) | 15.0 |
| CoO | (wt %) | 4.1 |
| $SiO_2$ | (wt %) | 0.3 |
| MgO | (wt %) | — |
| Physical Properties | | |
| Surface Area | (m$^2$/g) | 154.5 |
| Pore Volume | (cc/g) | 0.601 |
| Pore Distribution | | |
| 0–100 Å | (cc/g) | 0.024 |
| 100–200 Å | (cc/g) | 0.499 |
| 200–300 Å | (cc/g) | 0.058 |
| 300–600 Å | (cc/g) | 0.020 |

Table 7

| Catalyst | (I) | (II) |
|---|---|---|
| Asphaltenes (wt %) | 3.1 | 3.2 |
| Chemical Hydrogen Consumption (SCF/BBL) | 420 | 980 |
| Vanadium (ppm) | 70 | 210 |

Table 8

| | |
|---|---|
| Reaction temperature (°C.) | 405 |
| Reaction pressure (kg/cm$^2$ G) | 140 |
| LHSV (Hr$^{-1}$) | 0.5 |
| $H_2$/oil ratio (Nl/l) | 1000 |

Table 9

| | Catalyst (I) | Catalyst (II) |
|---|---|---|
| Hydrogen comsumption (SCF/BBL) | 320 | 330 |
| Specific gravity ($D_{15/4°}$ C.) | 0.951 | 0.963 |
| Asphaltenes (wt%) | 4.5 | 10.6 |
| Vanadium (ppm) | 104 | 816 |
| Sulfur (wt%) | 3.14 | 3.03 |

Table 10

| | |
|---|---|
| Reaction temperature (°C.) | 405 |
| Reaction pressure (kg/cm$^2$ G) | 140 |
| LHSV *(Hr$^{-1}$) | 0.25 |
| $H_2$/oil ratio (Nl/l) | 1000 |

per fresh charge stock

Table 11

| | |
|---|---|
| Specific gravity ($D_{15/4°}$ C.) | 0.941 |
| Sulfur (wt %) | 2.40 |
| Nitrogen (wt %) | 0.45 |
| Vanadium (ppm) | 18 |
| Nickel (ppm) | 6 |
| Asphaltenes (wt %) | trace |

Table 12

| | |
|---|---|
| Specific gravity ($D_{15/4°}$ C.) | 1.036 |
| Asphaltenes (wt %) | 13.5 |
| Sulfur (wt %) | 5.27 |
| Vanadium (ppm) | 181 |
| Nitrogen (ppm) | 3600 |

Table 13

| | |
|---|---|
| Reaction temperature (°C.) | 405 |
| Reaction pressure (kg/cm$^2$ G) | 140 |
| LHSV *(Hr$^{-1}$) | 0.3 |
| $H_2$/oil ratio (Nl/l) | 1000 |

*Reactor feed oil base.

Table 14

| Properties of Product Oil | |
|---|---|
| Specific gravity ($D_{15/4°}$ C.) | 0.946 |
| Sulfur (wt %) | 2.46 |
| Nitrogen (wt %) | 0.24 |
| Vanadium (ppm) | 1.7 |
| Nickel (ppm) | 1.1 |
| Asphaltenes (wt %) | trace |

Table 15

| Properties of Product Oil | |
|---|---|
| Specific gravity ($D_{15/4°}$ C.) | 0.927 |
| Sulfur (wt %) | 2.26 |
| Nitrogen (wt %) | 0.18 |
| Vanadium (ppm) | 1.4 |
| Nickel (ppm) | 1.2 |
| Asphaltenes (wt %) | trace |

Table 16

| | |
|---|---|
| Reaction temperature (°C.) | 405 |
| Reaction pressure (kg/cm$^2$ G) | 140 |
| LHSV (Hr$^{-1}$) | 0.8 |

Table 16-continued

| | |
|---|---|
| $H_2$/oil ratio (Nl/l) | 1000 |

Table 17

| | |
|---|---|
| Reaction temperature (°C.) | 405 |
| Reaction pressure (kg/cm$^2$ G) | 140 |
| LHSV *(Hr$^{-1}$) | 0.42 |
| $H_2$/oil ratio (Nl/l) | 1000 |

*per unit volume of reactor feed oil fed to step (a)

Table 18

| | |
|---|---|
| Specific gravity ($D_{15/4°}$ C.) | 0.943 |
| Sulfur (wt %) | 2.42 |
| Nitrogen (wt %) | 0.23 |
| Vanadium (ppm) | 1.6 |
| Nickel (ppm) | 1.2 |
| Asphaltenes (wt %) | trace |

Although the present invention has been described in conjunction with certain preferred embodiments thereof, it is not limited to these embodiments but instead includes all those embodiments within the scope and spirit of the appended claims.

EXAMPLE 5

Charge stock B containing asphaltenes in a large quantity was subjected of the hydrotreating by using a catalyst (III) which supported cobalt and molybdenum on a attapulgite containing magnesium silicate as a major component.

Properties of this catalyst are as shown in the following table.

| Composition of catalyst (III) | | |
|---|---|---|
| $Al_2O_3$ | (wt %) | 13.2 |
| $MoO_3$ | (wt %) | 4.9 |
| CoO | (wt %) | 1.7 |
| $SiO_2$ | (wt %) | 55.7 |
| MgO | (wt %) | 9.2 |
| $Fe_2O_3$ | (wt %) | 2.9 |
| FeO | (wt %) | 0.1 |
| CaO | (wt %) | 1.8 |

The results are shown below. Charge stock B containing asphaltenes in a large quantity was mixed at a flow rate of 350 cc/hr with a hydrogen-rich gas in a hydrogen/oil ratio of 700 Nl/l i.e., at a hydrogen flow rate of 245 Nl/hr, then preheated in a heater and sent to a reaction step.

Said reaction step comprised a fixed bed isothermal reactor of gas-liquid cocurrent upward flow type filled with catalyst (III). The reaction conditions are as shown in the following table.

| Reaction conditions | | |
|---|---|---|
| temperature | (°C.) | 410 |
| pressure | (kg/cm$^2$ G) | 100 |
| LHSV* | (hr$^{-1}$) | 0.3 |
| $H_2$/oil ratio | (Nl/l) | 700 |

*based on charge stock

The reaction product obtained from the reaction step was separated into a hydrogen-rich gas and a substantially liquid products in a gas-liquid separator.

As to the separating conditions in the gas-liquid separator the pressure was substantially the same as in the reactor, and the temperature was 150° C.

Further, the hydrogen-rich gas was scrubbed in an amine scrubber to remove the impurities such as excess hydrogen sulfide and ammonia, and after having been mixed with make-up hydrogen fed to the reaction step, it was used for recycling. Also, in order to avoid that the light hydrocarbon gas concentration in the recycling gas increases excessively, one portion, or about 10%, of the recycling was withdrawn out of the system.

On the other hand, the above described liquid product was sent to a solvent deasphalting section, where deasphalting was effected using butane at an average tower temperature of about 130° C. under a pressure enough to maintain a liquid phase operation (40 $kg/cm^2G$ in this example).

In this deasphalting section about 65% by volume of the above described liquid products was separated and transferred into the solvent phase, which was sent to a solvent-recovering unit to recover the solvent.

Also, a heavy fraction containing a large amount of asphaltenes which was not dissolved in the solvent was recycled at about 200° C. to the reaction step. The amount recycled in this case was about 190 cc/hr. The charge point of the recycled oil was located on the charge stock feeding line at the upstream of the place wherein the oil was mixed with the hydrogen-rich gas. In this example a continuous operation over a period of 800 hours was attained. The product oil was excellent quality extremely low in asphaltenes and heavy metal contents, shown as follows.

| Properties of product oil | | |
|---|---|---|
| specific gravity | (D15/4° C.) | 0.943 |
| asphaltenes | (wt %) | trace |
| sulfur | (wt %) | 2.12 |
| vanadium | (ppm) | 1.6 |

The yield of the products was not less than 96% by weight, and the chemical hydrogen consumption was 400 SCF/BBL.

What is claimed is:

1. In a process for treating heavy hydrocarbon oil which contains asphaltene and heavy metals to continuously convert the oil into a substantially asphaltene-free and heavy metal-free oil comprising the steps of:

(a) contacting said reactor feed oil with hydrogen in the presence of a catalyst;

(b) separating said withdrawn hydrotreated product into a hydrogen-rich gas and a liquid product;

(c) separating the liquid product of step (b) into a substantially asphaltene-free and heavy metal-free light fraction and an asphaltene-containing and heavy metal-containing heavy fraction; and (d) recycling said heavy fraction of step (c) to step (a), the improvement in step (a) comprising maintaining the reactor feed oil so as to contain at least 5 weight % of asphaltene and at least 80 ppm of vanadium, contacting said reactor feed oil with the catalyst compound of one or more catalytic metals selected from the groups Va, VIa and VIII in the Periodic Table, supported on a carrier containing magnesium silicate as the major component, and withdrawing the hydrotreated product without entraining the catalyst therein.

2. The process as described in claim 1 wherein said fresh charge stock is fed to step (a) in the recycling system.

3. The process as described in claim 1 wherein said fresh charge stock is fed to step (c) in the recycling system.

4. The process as described in claim 1 wherein fresh charge stock is pretreated by contacting it with hydrogen in the presence of a catalyst comprising a carrier containing magnesium silicate as a major component and having supported thereon one or more catalytic metal components, the metals being selected from the metals of Groups Va, VIa and VIII of the Periodic Table, under a hydrogen/oil ratio of 100–2000 (normal l/l), a temperature of 300°–450° C., a pressure of 30–250 $kg/cm^2G$, and a liquid hourly space velocity of 0.1–10 $Hr^{-1}$ and is fed to step (b) in the recycling system.

5. The process as described in claims 1, 2, 3 or 4 wherein said step (a) is carried out under a hydrogen/oil ratio of 500–1000 (normal l/l), in a temperature of 390°–420° C., a pressure of 80–160 $kg/cm^2G$, and a liquid hourly space velocity of 0.2–5 $Hr^{-1}$.

6. The process as described in claims 1, 2, 3 or 4 wherein said catalytic metal components are of one or more metals selected from the group consisting of Co, Mo, Ni, V and W.

7. The process as described in claims 1, 2, 3 or 4 wherein said hydrogen-rich gas contains 10% or less of $H_2S$.

8. The process as described in claims 1, 2, 3 or 4 wherein the said carrier comprises 30–60 wt% of $SiO_2$, 10–30 wt% of MgO, less than 8 wt% of $Al_2O_3$, less than 25 wt% of $Fe_2O_3$, less than 5 wt% of FeO,and less than 3 wt% of CaO.

9. The process as described in claim 8 wherein said carrier is sepiolite.

10. The process as described in claim 9 wherein said catalytic metal components are of one or more metals from the group consisting of Co, Mo, Ni, V and W.

11. The process as described in claims 1, 2, 3 or 4 wherein said step (c) is a solvent deasphalting process.

* * * * *